United States Patent [19]

Barrington et al.

[11] 3,981,188

[45] Sept. 21, 1976

[54] METHOD AND APPARATUS FOR TESTING WELLS

[75] Inventors: Burchus Q. Barrington; David L. Farley; O. L. Morrisett, all of Duncan, Okla.

[73] Assignee: Halliburton Company, Duncan, Okla.

[22] Filed: Oct. 24, 1974

[21] Appl. No.: 517,488

[52] U.S. Cl. ..... 73/155

[51] Int. Cl.[2] ..... E21B 49/00

[58] Field of Search..... 73/155, 152, 151, 421 R; 166/100, 264; 175/233

[56] References Cited

UNITED STATES PATENTS

| | | | |
|---|---|---|---|
| 2,125,159 | 7/1938 | Hanes | 73/154 |
| 2,222,829 | 11/1940 | Hamason et al. | 73/154 |
| 3,308,882 | 3/1967 | Lebourg | 73/155 |
| 3,356,137 | 12/1967 | Raugust | 73/155 UX |
| 3,813,935 | 6/1974 | Tanguy et al. | 73/153 |

*Primary Examiner*—Jerry W. Myracle
*Attorney, Agent, or Firm*—John H. Tregoning

[57] ABSTRACT

Method and apparatus for testing wells where extremely high temperatures and pressures are to be encountered in the zone under test. The apparatus provides means for testing and trapping samples of well fluid from the formation in the zone under test for removal from the well bore with substantial reduction in sample pressure at the ground surface. The method permits confining the well fluid under test within the well bore near the zone under test to minimize the possibility of hazardous well fluids reaching the ground surface other than as trapped samples in expandable sampler chambers or otherwise safely controlled.

21 Claims, 17 Drawing Figures

METHOD AND APPARATUS FOR TESTING WELLS

BACKGROUND OF THE INVENTION

1. Field of the Invention

The present invention relates to oil and gas well testing and, more particularly, but not by way of limitation, to method and apparatus for safely testing and sampling potentially hazardous well fluids in hostile environments.

2. Description of the Prior Art

In the past, formation testing has been employed to determine the potential productivity of subsurface formations in either open or cased well bores. The prior art testing procedure requires the opening of a section of the well bore to atmospheric or reduced pressure. The prior art method has previously been accomplished by lowering a test string into the well bore on drill pipe with the tester valve closed to prevent entry of well fluid into the drill pipe. With the packer of the testing string expanded to provide a seal above the zone to be tested, the tester valve is opened. The packer is then relied upon to support the hydrostatic pressure load of the well fluid. The formation below the packer is relieved of this pressure and is exposed through the open tester valve to the atmospheric pressure in the empty drill pipe so that its ability to produce fluid can be determined.

After a specified time interval, the formation is closed in to measure its rate of pressure build-up.

At the end of the test the tester valve is closed and pressure is equalized across the packer to permit it to be unseated. Formation fluid recovered during the test can be removed from the drill pipe by reverse circulation before the pipe is removed from the hole. Formation pressures are generally recorded throughout the test by a subsurface pressure recording device included in the testing string.

Such prior art formation testing techniques are not appropriate for extremely deep wells where formation pressures of approximately 20,000 p.s.i. and temperatures of approximately 500° F. may be encountered. Safety considerations prevent the venting of such formation pressures to the atmosphere as is common practice in the prior art. This limitation of the prior art method and apparatus is particularly apparent when $H_2S$ or $CO_2$ is a substantial component of the well fluids encountered in the zone under test.

SUMMARY OF THE INVENTION

The present invention contemplates apparatus for testing a formation in a zone penetrated by a well bore which includes conduit means positionable in the well bore for conveying fluids therethrough within the well bore. The conduit means includes sampler chamber means in selective communication with the interior of the conduit means. The valve means is carried by the conduit means and is responsive to manipulation of the conduit means for selectively opening conduit means to fluid flow bypassing the sampler chamber means, and, alternately, directing fluid flow from the interior of the conduit means through the sampler chamber means and back into the interior of the conduit means, and again opening the conduit means to fluid flow bypassing the sampler chamber means while simultaneously trapping a fluid sample in the sampler chamber means. The conduit means also carries well bore isolation means responsive to manipulation of the conduit means for selectively isolating the zone under test from the annulus between the exterior of the conduit means and the wall of the well bore. The conduit means includes a port means carried therein below the well bore isolation means for providing fluid communication between the isolated zone under test and the interior of the conduit means. The conduit means further carries valve means above the sampler chamber means for selectively opening and closing the conduit means to fluid flow therethrough.

It is an object of the present invention to provide a drill test string suitable for testing zones in extremely deep well bores.

Another object of the invention is to provide a method of safely testing and sampling formation fluids from the zone under test in extremely deep well bore.

A further object of the invention is to provide an improved sampler chamber assembly for trapping high pressure well fluid samples and providing means for safely conveying the samples to the ground surface for testing and evaluation.

Other objects and advantages of the invention will be evident from the following detailed description when read in conjunction with the accompanying drawings.

BRIEF DESCRIPTION OF THE DRAWINGS

FIG. 9 is an enlarged vertical cross-sectional view of a portion of the drill test string of FIG. 1 illustrating the upper safety joint assembly and the upper end portion of the packer assembly.

DESCRIPTION OF THE PREFERRED EMBODIMENT

Figure 1:
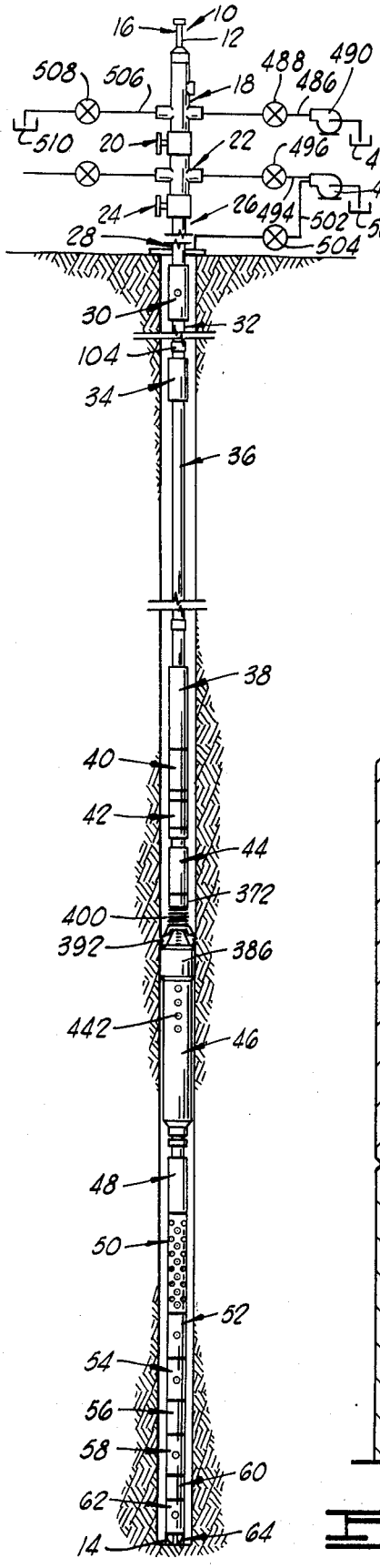
FIG. 1 is an elevational view illustrating the drill test string of the present invention positioned in a well bore.
Figure 2:
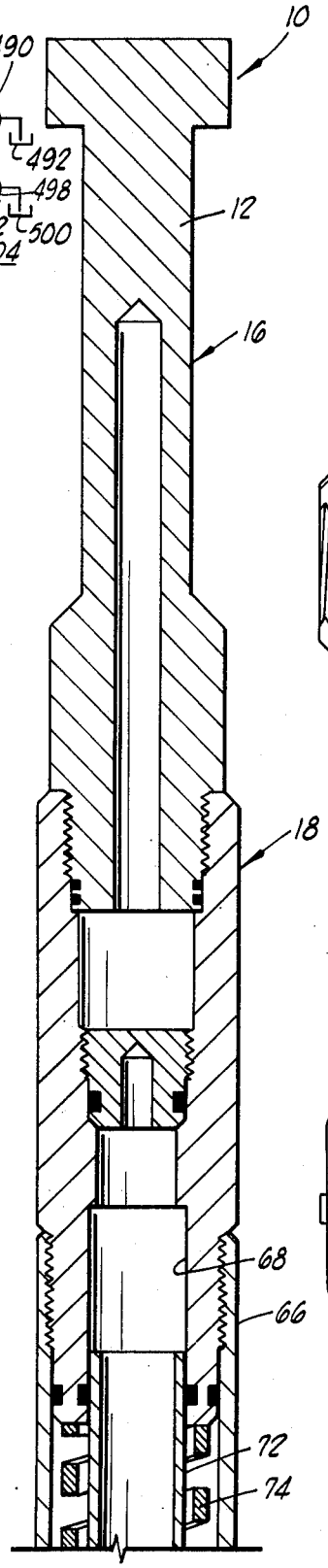
FIG. 2 is an enlarged vertical cross-sectional view of the upper end portion of the drill test string of FIG. 1 illustrating the lifting sub and the upper portion of the sleeve type safety valve assembly.
Figure 3:
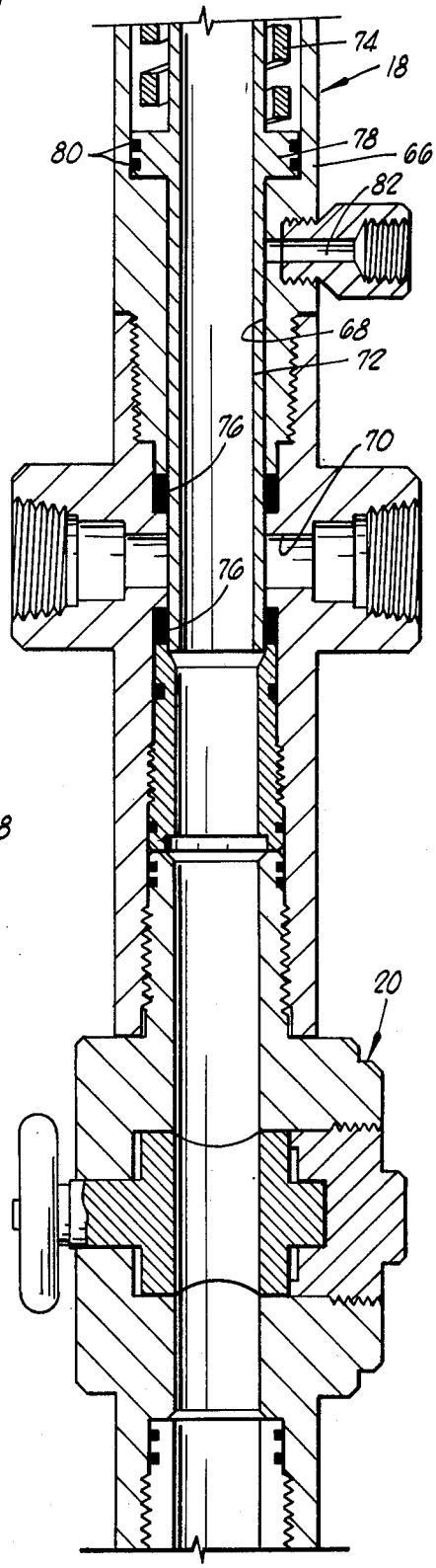
FIG. 3 is an enlarged cross-sectional view of a portion of the drill test string of FIG. 1 illustrating the lower portion of the sleeve type safety valve assembly and the upper master valve assembly.
Figure 4:
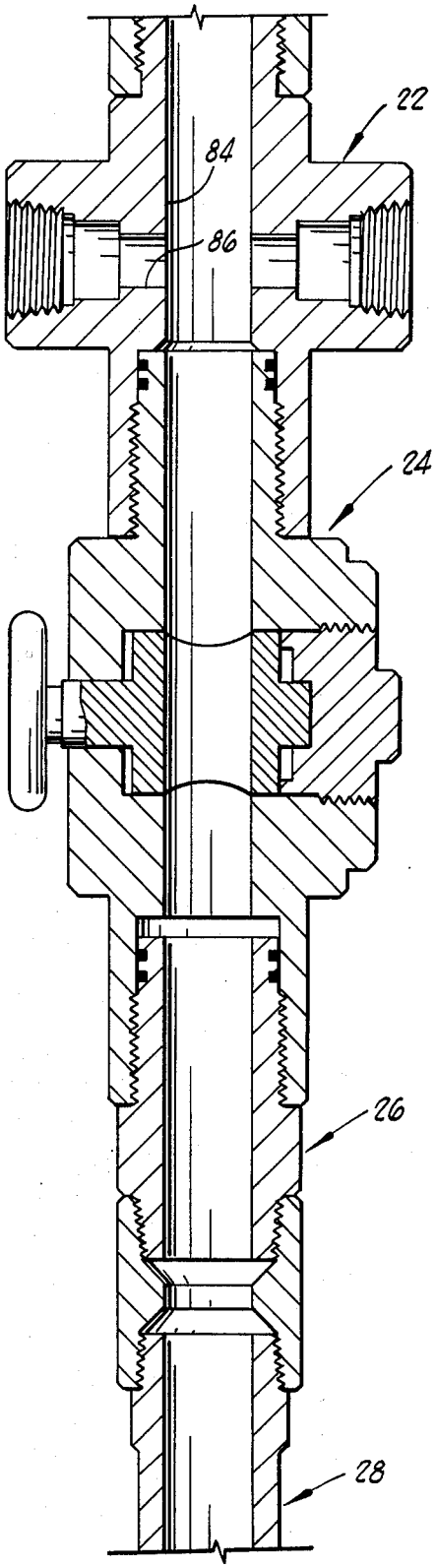
FIG. 4 is an enlarged vertical cross-sectional view of a portion of the drill test string of FIG. 1 illustrating the flow cross kill line connection assembly, the lower master valve assembly, the tubular threaded adapter and the upper end portion of the first length of drill pipe.
Figure 5:
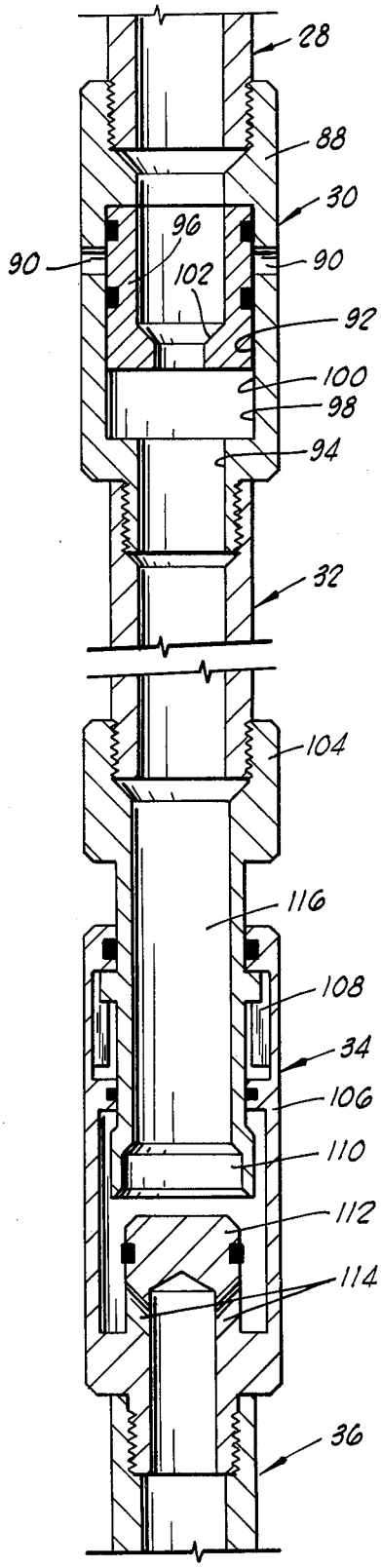
FIG. 5 is an enlarged vertical cross-sectional view of a portion of the drill test string of FIG. 1 illustrating the lower end portion of the first length of drill pipe, the sleeve impact reversing sub, the second length of drill pipe, the uphole safety valve assembly and the upper end portion of the third length of drill pipe.

Referring now to the drawings, the drill test string of the present invention is generally designated by the reference character 10 and is shown in FIG. 1. The test string 10 comprises the following elements moving from the upper end portion 12 to the lower end portion 14 in consecutive order: a lifting sub 16; a remotely controlled fluid actuated, sleeve-type safety valve assembly 18; and upper master valve assembly 20; a flow cross kill line connection assembly 22; a lower master valve assembly 24; a tubular threaded adapter 26; a first length of drill pipe 28; a sleeve impact reversing sub 30; a second length of drill pipe 32; an uphole, gravity-actuated safety valve assembly 34; a third length of drill pipe 36; a gravity-actuated flow direction valve and expandable sampler chamber assembly 38; a flow stream recorder assembly 40; a hydraulic jar asembly 42; an upper safety joint assembly 44; a packer assembly 46; a lower or anchor pipe safety joint assembly 48; a perforated anchor pipe 50; a check valve assembly 52; a miximum temperature thermometer assembly 54; a temperature recorder assembly 56; an upper blanked-off pressure recorder assembly 58; a tubular spacer element 60; a lower blanked-off pressure recorder assembly 62; and an anchor shoe 64.

The sleeve type safety valve assembly 18 includes a housing assembly 66 having a longitudinal passageway 68 extending therethrough. A transverse passageway 70 intersects the longitudinal passageway 68 and may be connected in communication with one or two separate conduits through which fluid may be introduced into or removed from the drill test string 10. A cylindrical valve member 72 is slidably received within the housing assembly 66 and is biased into a normally closed position blocking communication between the passageways 68 and 70 by means of a compression coil spring 74. Annular seals 76 provide a fluid-tight seal between the valve member 72 and the housing assembly 66 when the valve is closed. An annular piston 78 is formed on the valve member 72 and carries annular seals 80 thereon to provide a sliding fluid-tight seal between the piston 78 and the inner periphery of the housing assembly 66. The valve is opened against the bias of the spring 74 by the application of a sufficient fluid pressure through port 82 formed in the housing assembly 66 which pressure acts on the differential area defined by the inner periphery of the housing assembly 66 engaged by the annular seals 80 and the diameter of the lower portion of the valve member 72 engaged by the annular seals 76 to overcome the bias of the spring 74.

The upper and lower master valve assemblies 20 and 24 are of conventional design and may be operated individually to open and close the drill test string 10 to fluid flow therethrough as may be desired. The flow cross kill line connection assembly 22 includes a longitudinal passageway 84 therethrough and a transverse passageway 86 formed therein intersecting the passageway 84. The passageway 86 may be connected with one or two separate conduits to which fluid may be introduced into or removed from the test string 10.

The tubular threaded adapter 26 provides threaded interconnection between the lower master valve assembly 24 and the upper end of the first length of drill pipe 28.

The sleeve impact reversing sub 30 includes a housing 88 threadedly secured to the lower end of the drill pipe 28. A plurality of ports 90 are formed in the housing 88 and communicate between a cylindrically shaped portion 92 of the longtudinal passageway 94 extending through the housing 88. A sleeve valve member 96 is releasably secured within the cylindrically shaped portion 98 of the longitudinal passageway 100. A suitable reversing sub for this application is manufactured and sold by Halliburton Services and is described on page 2544 of the Halliburton Services Sales and Service Catalog, Number 37.

The sleeve valve member 96 may be suitably secured within the cylindrically shaped portion 98 of the longitudinal passageway 100 by means of shear pins (not shown) or the like. When desired, the sleeve valve member 96 may be released by dropping a bar down the drill test string 10 which will impact on the annular shoulder 102 of the sleeve valve member 96 thereby forcing it downwardly within the longitudinal passageway 100 and providing communication between the longitudinal passageway 100 and the exterior of the housing 88 via the ports 90 to permit reverse circulation therethrough.

The upper end portion of the second length of drill pipe 32 is threadedly secured to the lower end portion of the housing 88 of the sleeve impact reversing sub 30. The lower end portion of the drill pipe 32 is threadedly secured to the upper end portion of a mandrel 104 forming a portion of the uphole safety valve assembly 34.

In addition to the mandrel 104, the uphole safety valve assembly 34 further includes a housing 106 in which the mandrel 104 is slidably received. The mandrel 104 is prevented from rotating relative to the housing 106 by means of longitudinal splined engagement therebetween as shown at 108. It will be seen that when the mandrel 104 is telescoped downwardly relative to the housing 106 fluid passage through the uphole safety valve assembly 34 is precluded through the sealing engagement of the lower end portion 110 of the mandrel 104 with an upwardly extending cylindrically shaped member 112 formed in the lower portion of the housing 106. When the mandrel 104 is fully extended relative to the housing 106 it will be seen that fluid may pass through the uphole safety valve assembly 34 via ports 114 formed in the member 112 and through the cylindrically shaped passageway 116 extending through the mandrel 104.

The upper end portion of the third length of drill pipe 36 is threadedly secured to the lower end portion of the housing 106 of the uphole safety valve assembly 34. The lower end portion of the drill pipe 36 is threadedly secured to the upper end portion of the flow direction valve and expandable sampler chamber assembly 38.

The expandable sampler chamber assembly 38 comprises a housing assembly 118 and a mandrel assembly 120. The housing assembly 118 includes an upper housing 122, an intermediate housing 124 and a lower housing 126. The housings 122, 124 and 126 are substantially cylindrically shaped. The lower end portion 128 of the upper housing 122 slidingly and sealingly receives the upper end portion 130 of the intermediate housing 124 therein. Similarly, the lower end portion 132 of the intermediate housing slidingly and sealingly receives the upper end portion 134 of the lower housing 126 therein.

The mandrel assembly 120 comprises an operating mandrel 136, an upper sampler mandrel 138 and a lower sampler mandrel 140. The upper end portion 142 of the operating mandrel 136 is suitably threadedly secured to the lower end portion of the drill pipe 36 by means of a suitably threaded collar 144. Below its connection with the drill pipe 36 the operating mandrel is slidably received within the upper housing 122. The upper sampler mandrel 138 is slidably received within the housing assembly 118 with the upper end portion 146 disposed within the upper housing 122 and with the lower end portion 148 disposed within the intermediate housing 124. The upper end portion 146 of the upper sampler mandrel 138 is releasably securable to the lower end portion 150 of the operating mandrel 136 and, alternately, releasably securable to the inner portion of the upper housing 122 as will be described in detail hereinafter. The lower end portion 148 of the upper sampler mandrel 138 is releasably securable to the upper end portion 152 of the lower sampler mandrel 140 by suitable means.

The mandrel assembly 120 provides a tubular passageway 154 therethrough providing communication between the drill pipe 36 and the lower end portion 156 of the lower sampler mandrel 140. The tubular passageway 154 comprises passageway 158 formed in the operating mandrel 136, passageway 160 formed in the upper sampler mandrel 138, and the passageway 162 formed in the lower sampler mandrel 140.

A J-slot lug collar 164 is positioned about the upper end portion 142 of the operating mandrel 136. The lug collar 164 includes a pair of radially outwardly extending lugs 166 formed thereon and positioned diammetrically opposite one another. The lugs 166 are respectively received in a pair of identical J-slots 168 formed in the upper housing 122 and also positioned diammetrically opposite one another. A compression coil spring 170 is disposed around the operating mandrel 136 with the upper end 172 abutting the collar 164 and with the lower end 174 abutting a radially inwardly extending annular shoulder 176 formed in the upper housing 122. The compression coil spring 170 provides a predetermined upward bias on the operating mandrel 136 relative to the upper housing 122. An annular seal 178 provides a fluid-tight seal between the interior wall of the upper housing 122 and the outer cylindrical surface of the operating mandrel 136. The annular space between the operating mandrel 136 and the upper housing 122 above the annular seal 178 is vented to the exterior of the upper housing 122 via a pressure equalization port 180.

A cylindrically shaped annular space 182 is formed within the upper housing 122 between the cylindrical inner wall 184 of the upper housing and the cylindrical outer periphery 186 of the operating mandrel 136. An annular pressure equalizing piston 188 is positioned within the annular space 182 and provides sliding sealing engagement between the inner wall 184 of the upper housing and the outer periphery 186 of the operating mandrel. The annular space between the pressure equalizing piston 188 and the annular seal 178 is vented to the exterior of the upper housing via a pressure equalizing port 190.

A radially inwardly extending annular shoulder 192 is formed within the upper housing 122 and extends from the inner wall 184. The annular shoulder 192 includes a plurality of longitudinally extending grooves 194 formed therein. A plurality of longitudinally extending splines 196 are formed on the outer periphery 186 of the operating mandrel 136 and are longitudinally slidingly received within the grooves 194 to prevent relative rotation between the operating mandrel and the upper housing. The lower end of the annular shoulder 192 communicates with a cylindrical inner wall 198 formed within the upper housing 122.

An outwardly extending annular shoulder 200 is formed on the operating mandrel 136 and includes an annular seal 202 carried therein to provide a sliding fluid-tight seal between the annular shoulder 200 and the cylindrical inner wall 198. It will be seen that the annular shoulder 200 provides a positive limitation to the upward movement of the operating mandrel 136 within the upper housing 122. An annular seal 204 is carried within the upper housing 122 and provides a sliding fluid-tight seal between the cylindrical inner wall 206 of the upper housing and the cylindrical outer periphery 208 of the operating mandrel 136 which extends downwardly from the annular shoulder 200.

The annular space between the upper housing 122 and the operating mandrel 136 intermediate the pressure equalizing piston 188 and the annular seal 204 defines a hydraulic impedance oil reservoir 210. A plurality of passageways 212 of extended length and restricted cross-sectional area communicate between hydraulic impedance inlet ports 124 positioned below the annular shoulder 200 and annular seal 202 and hydraulic impedance outlet ports 216 formed in the operating mandrel 136 above the annular shoulder 200 and annular seal 202. Hydraulic impedance dump ports 218 communicate between the cylindrical inner wall 198 of the upper housing 122 and an annular passageway 220 which provides means for fast downward movement of the operating mandrel 136 relative to the upper housing 122 for a limited distance when the annular seal 202 moves below the dump ports 218 during the operation of the apparatus. It will be understood when the apparatus is assembled, the hydraulic impedance oil reservoir 210 and the passageways 212 are filled with oil.

It should be understood that the hydraulic impedance structure described above operates when weight is placed on the operating mandrel 136 to move it downwardly relative to the upper housing 122 against the upward bias of the coil spring 170. As the operating mandrel 136 moves downwardly, the oil trapped in the reservoir 210 below the annular seal 202 is forced through the ports 214 and the restrictive passageways 212 outwardly through the outlet ports 216 into the reservoir above the seal 202. The cross-sectional area of the passageways 212 will have been preselected to provide a suitable impedance to the downward movement of the operating mandrel relative to the upper housing. It will also be seen that when the annular seal 202 moves below the dump ports 218, the oil in the reservoir below the seal 202 is free to flow rapidly through the annular passageway 220 and the dump ports 218 into the annular space above the seal 202 thus allowing much faster downward movement of the operating mandrel 136 relative to the upper housing 122 for a limited distance. This sudden increase in downward movement of the operating mandrel provides indication at the ground surface that the operating mandrel has moved to its lowermost position and that the sampler chambers are open as will be described more fully hereinafter.

Figure 14:
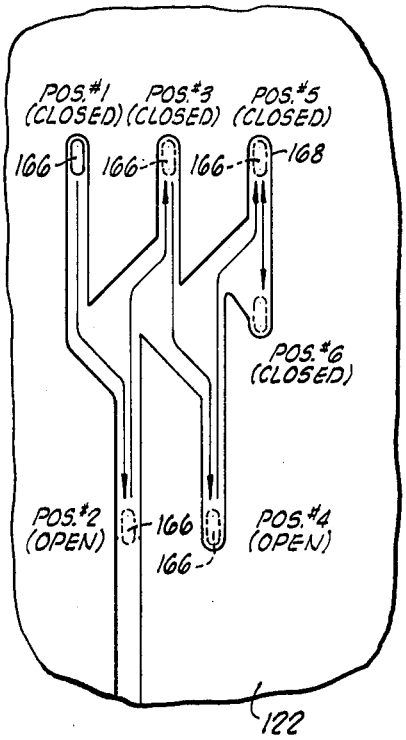
FIG. 14 is a schematic illustration of lug and slot components of one of the J-slots of the flow direction and expandable sampler chamber assembly.

FIG. 14 illustrates diagrammatically the lay-out of one J-slot 168 illustrating the various positions of the respective lug 166 therein. It will be seen that when the lug 166 is in position No. 1 as is illustrated in FIG. 14, the sampler chambers of the flow direction valve and expandable sampler chamber assembly 38 are closed as will be described in more detail hereinafter. When weight is set on the operating mandrel 136, sufficient to overcome the bias of the spring 170 and the retardation applied by the hydraulic impedance mechanism, the lug 166 is moved to position No. 2 which opens the sampler chambers. When weight is removed from the operating mandrel 136 sufficient to allow full extension of the compression spring 170, the lug 166 moves to position No. 3 in the J-slot 168 which again places the sampler chambers in closed position. A second downward movement of the operating mandrel 136, as described immediately above, will position the lug 166 in position No. 4 thus placing the sampler chambers in the open position for a second and last time. When weight is removed from the operating mandrel 136, sufficient for the compression spring 170 to fully extend a second time, the lug 166 assumes position No. 5 thereby closing the sampler chamber a second and last time. Any additional vertical manipulation of the operating mandrel 136 relative to the upper housing 122 will only cause the lug 166 to move between positions No. 5 and No. 6, both of which retain the sampler chambers in the closed position.

The lower end portion 150 of the operating mandrel 136 is removably securable to the upper end portion 146 of the upper sampler mandrel 138 by means of a plurality of upwardly extending spring locking fingers 222 formed on the upper end portion 146 of the upper sampler mandrel.

Figure 6A:
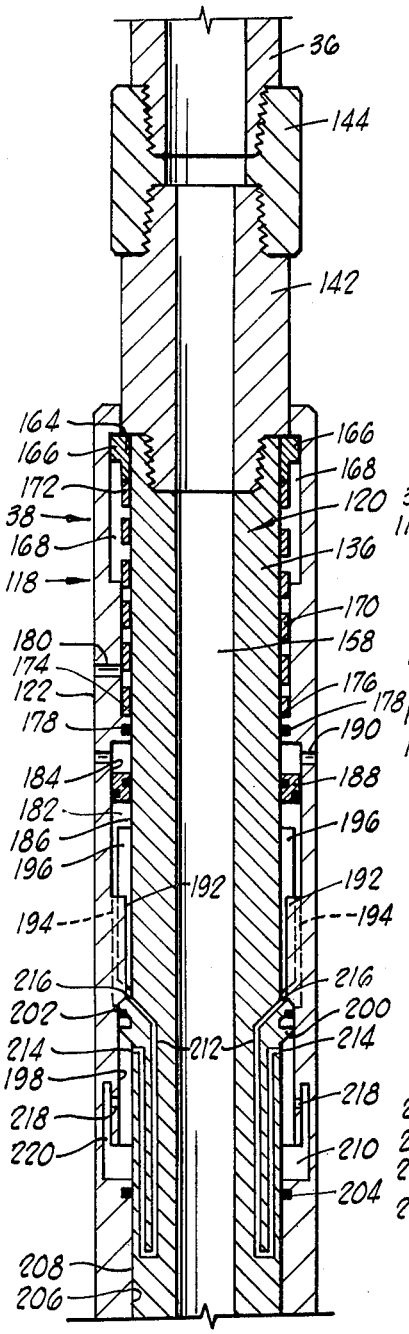
FIG. 6A is an enlarged vertical cross-sectional view of a portion of the drill test string of FIG. 1 illustrating the lower end portion of the third length of pipe and the upper portion of the flow direction valve and expandable sampler assembly when the expandable sampler chambers are closed and the flow direction valve and expandable sampler assembly is open to fluid flow therethrough around the closed sampler chambers.
Figure 6B:
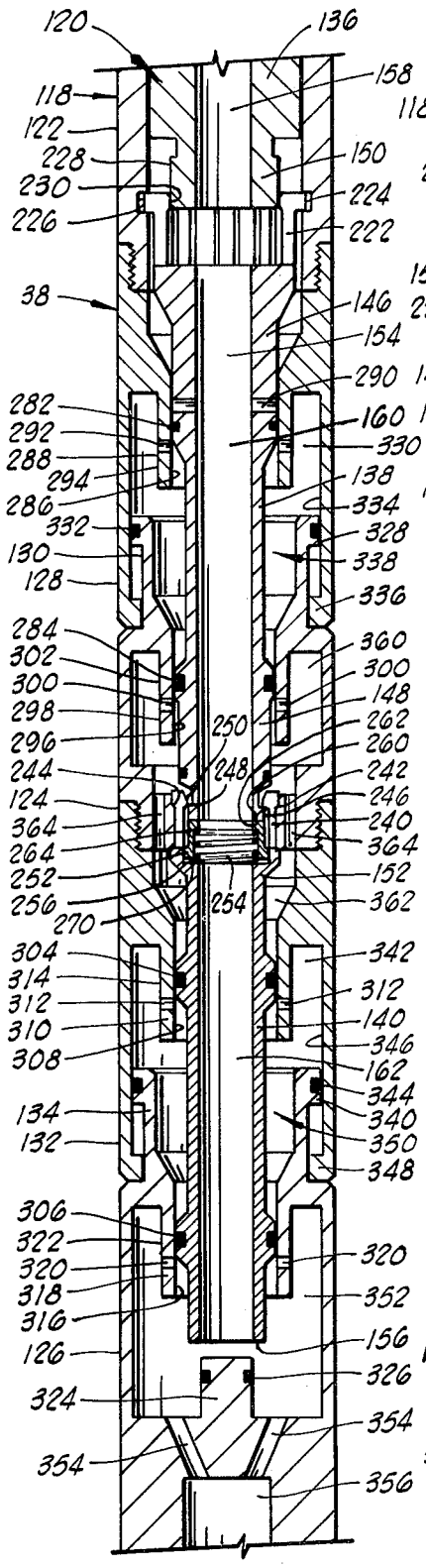
FIG. 6B is an enlarged vertical cross-sectional view of a portion of the drill test string of FIG. 1 illustrating the lower portion of the flow direction valve and expandable sampler assembly when the expandable sampler chambers are closed and the housing assembly is telescopically collapsed.

As shown in FIGS. 6A and 6B, when the operating mandrel 136 is in its upper position with the lugs 166 in position Nos. 1, 3 or 5 in the J-slot 168, radially outwardly extending shoulders 224 formed on the spring locking fingers 222 are securely engaged in an annular groove 226 formed within the upper housing 122 thereby preventing longitudinal movement of the upper sampler mandrel 138 relative to the upper housing 122. The annular shoulders 224 of the spring fingers 222 are securely retained in engagement with the annular grooves 226 by means of cylindrical surface 228 formed on the lower end portion 150 of the operating mandrel which slidingly engages the radially inwardly extending shoulders 200 formed on the upper ends of the spring fingers 222.

When the operating mandrel 136 is moved downwardly relative to the upper housing 122 to assume either position No. 2 or position No. 4, the lower end face 232 of the operating mandrel engages the upper end face 234 of the upper sampler mandrel 138. This positions an annular groove 236 formed in the cylindrical surface 228 of the operating mandrel in registration with the inwardly extending shoulders 230 of the spring fingers 222 thus releasing the locking force exerted on the spring fingers 222 which previously retained the radially outwardly extending shoulders 224 in engagement with the annular shoulder 226 of the upper housing 122. With the locking fingers 222 thus released from engagement with the upper housing 122, the further downward movement of the operating mandrel 136 relative to the upper housing 122 causes the release of the upper sampler mandrel 138 from the upper housing and the simultaneous engagement of the upper sampler mandrel 138 with the operating mandrel 136 through the engagement of the shoulders 230 of the locking fingers 222 with the annular groove 236. The engagement of the inwardly extending shoulders 230 with the annular groove 236 is maintained through the sliding engagement of cylindrical inner surface 238 of the upper housing with the radially outwardly extending shoulders 224 of the spring locking fingers 222.

Figure 7A:
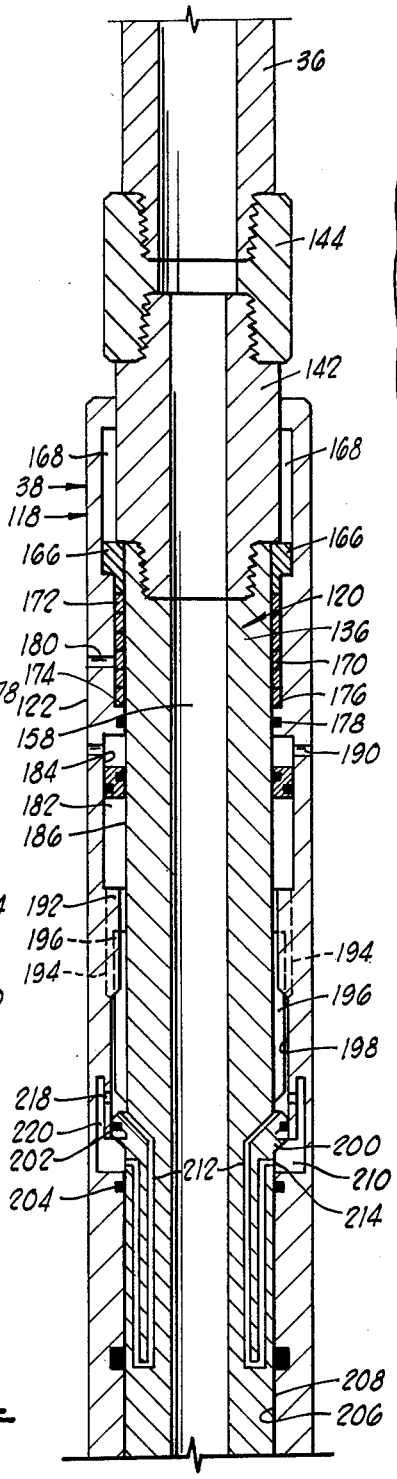
FIG. 7A is an enlarged vertical cross-sectional view of a portion of the drill test string of FIG. 1, similar to FIG. 6A, and illustrating the lower end portion of the third length of pipe and the upper portion of the flow direction valve and expandable sampler assembly when the expandable sampler chambers are open and the flow direction valve and expandable sampler assembly is open to fluid flow therethrough through the open sampler chambers.
Figure 7B:
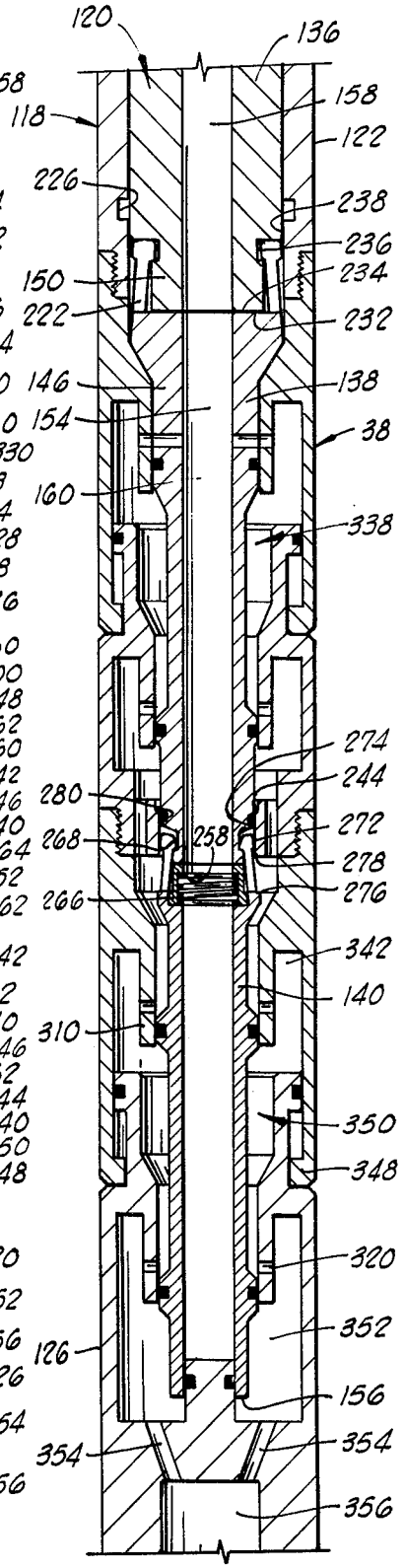
FIG. 7B is an enlarged vertical cross-sectional view of a portion of the drill test string of FIG. 1, similar to FIG. 6B, and illustrating the lower portion of the flow direction valve and expandable sampler assembly when the expandable sampler chambers are open and the housing assembly is telescopically collapsed.
Figure 8:
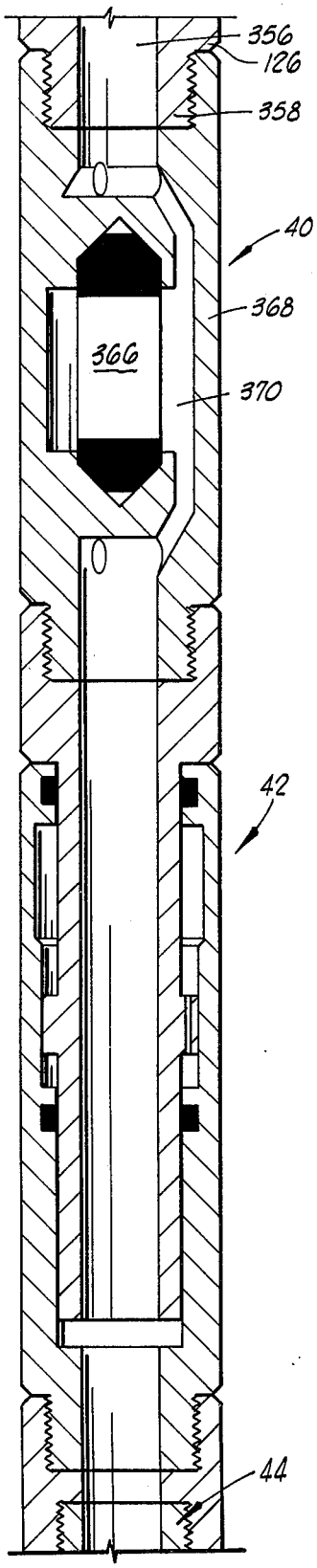
FIG. 8 an enlarged vertical cross-sectional view of a portion of the drill test string of FIG. 1 illustrating the lower end portion of the flow direction valve and expandable sampler assembly, the flow stream recorder assembly, the hydraulic jar assembly and the upper end portion of the upper safety joint assembly 44.
Figure 12:
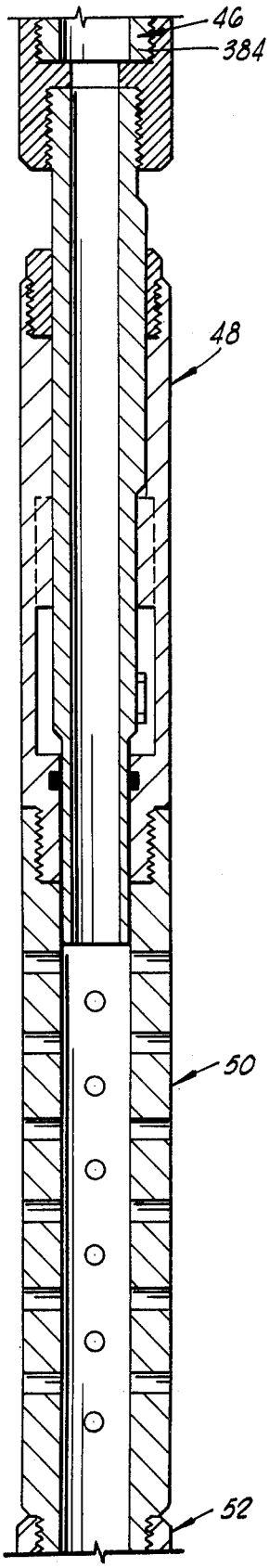
FIG. 12 is an enlarged vertical cross-sectional view of a portion of the drill test string of FIG. 1, illustrating the lower end portion of the packer assembly, the anchor pipe safety joint assembly, the perforated anchor pipe and the upper end portion of the check valve assembly.
Figure 13:
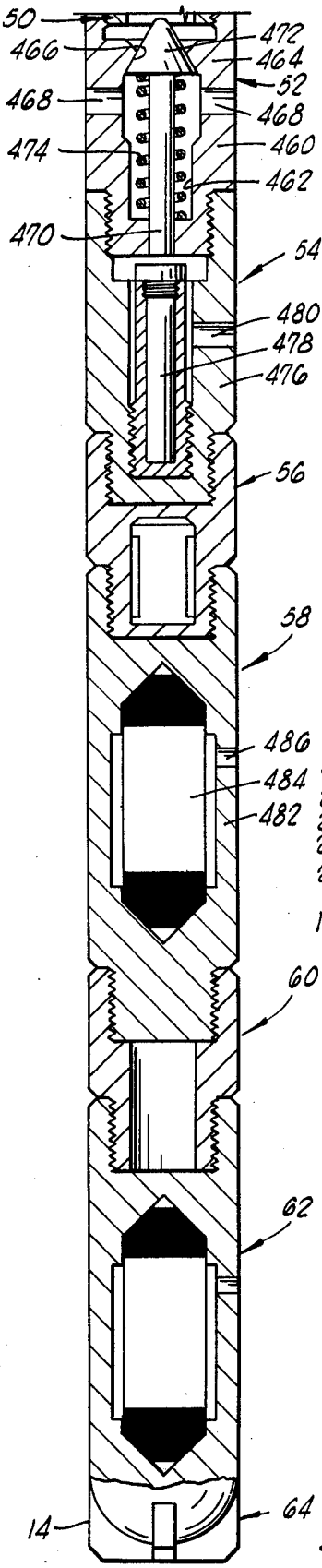
FIG. 13 is an enlarged vertical cross-sectional view of the lower end portion of the drill test string of FIG. 1 illustrating the lower end portion of the perforated anchor pipe, the check valve assembly, the maximum temperature thermometer assembly, the temperature recorder assembly, the upper blanked-off pressure recorder, the tubular spacer element, the lower blanked-off pressure recorder assembly and the anchor shoe.

As shown in FIGS. 6B and 7B, the lower end portion 148 of the upper sampler mandrel 138 is releasably secured to the upper end portion 152 of the lower sampler mandrel 140 by means of a plurality of upwardly extending spring locking fingers 240 formed on the upper end portion 152 of the lower sampler mandrel. In FIG. 6B, it will be seen that outwardly extending shoulders 242 formed respectively on the spring locking fingers 240 engage a radially inwardly extending annular shoulder 244 formed on the inner periphery of the intermediate housing 124 thus preventing the downward movement of the lower sampler mandrel 140 relative to the intermediate housing 124. The spring locking fingers 240 are retained in engagement with the annular shoulder 244 of the intermediate housing 124 through the engagement of cylindrical outer surface 246 of the upper sampler mandrel 138 with the cylindrically shaped surfaces 248 formed on the radially inwardly extending shoulder 250 of each spring locking finger 240.

A substantially cylindrically shaped piston 252 is slidably disposed within the spring fingers 240. A compression coil spring 254 extends between an upwardly facing annular shoulder 256 formed in the upper end portion 152 of the lower sampler mandrel 140 and a downwardly facing annular shoulder 258 formed within the piston 252. The coil spring 254 biases the piston 252 upwardly to engage the upper end face 260 of the piston with the lower end face 262 of the upper sampler mandrel 138. See FIG. 6C. The piston 252 includes a cylindrical outer surface 264 having a diameter substantially equal to the diameter of the cylindrical outer surface 246 of the upper sampler mandrel. A radially outwardly extending shoulder 266 is formed on the lower end of the piston 252 and extends outwardly from the surface 264.

It will be seen in FIG. 7B that when the lower end portion 148 of the upper sampler mandrel 138 is moved downwardly relative to the intermediate housing 124 an annular groove 268, formed in the lower end portion of the upper sampler mandrel, is positioned in registration with the inwardly extending shoulders 250 of the spring locking fingers 240. It will also be seen that the lower end face 262 of the upper sampler mandrel abuts the upper end face 260 of the piston 252, and the lower end face 270 of the piston 252 abuts the annular shoulder 256 of the lower sampler mandrel 140. As the upper sampler mandrel 138 forces the piston 252 and the lower sampler mandrel 140 downwardly relative to the intermediate housing 124, the outwardly extending shoulders 242 of the spring locking fingers 240 become disengaged with the annular shoulder 244 of the intermediate housing and the spring locking fingers are deflected inwardly such that the inwardly extending shoulders 250 extend into the annular groove 268 of the upper sampler mandrel thereby mutually engaging the upper and lower sampler mandrels. This mutual engagement is maintained through the sliding engagement between the outer cylindrical surfaces 272 of the outwardly extending shoulders 242 of each spring locking finger 240 and the cylindrical inner periphery 274 of the intermediate housing 124 adjacent thereto.

Figure 6C:
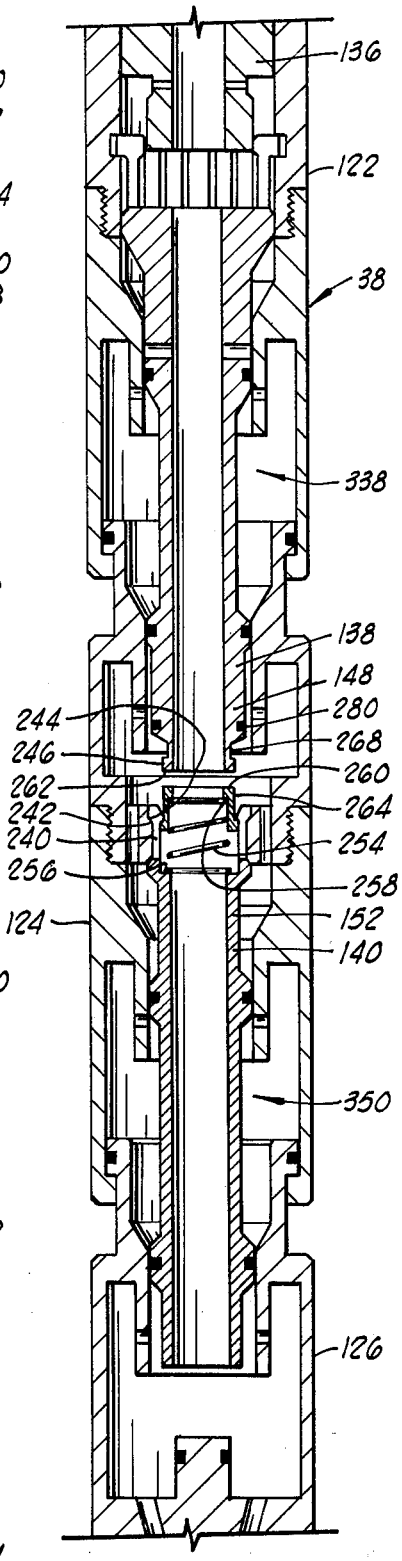
FIG. 6C is an enlarged vertical cross-sectional view of a portion of the drill test string of FIG. 1, similar to FIG. 6B, and illustrating the lower portion of the flow direction valve and expandable sampler assembly when the expandable sampler chambers are closed and the housing assembly is telescopically extended to expand the expandable sampler chambers.
Figure 8:
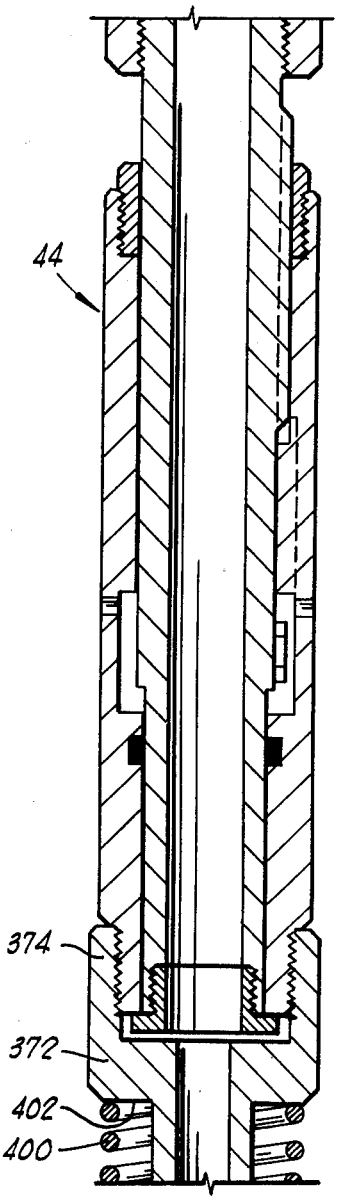

When the housing assembly 118 is longitudinally extended or expanded as shown in FIG. 6C, it will be seen that the locking fingers 240 again engage the lower sampler mandrel 140 to the intermediate housing 124 through the mutual engagement of the outwardly extending shoulders 242 of the spring locking fingers 240 with the annular shoulder 244 of the intermediate housing. Upward movement of the lower sampler mandrel 140 relative to the intermediate housing 124 is physically limited by the abutment of the annular shoulder 276 of the lower sampler mandrel 140 with annular shoulder 278 of the intermediate housing 124. The locking fingers 240 are retained in engagement with the intermediate housing 124 through the mutual sliding engagement between the outer cylindrical surface 264 of the piston 252 and the cylindrically shaped surfaces 248 of each locking finger 240, the piston 252 being biased upwardly into locking position through the extension of compression coil spring 254. With the spring fingers 240 so engaged with the intermediate housing 124, the upper sampler mandrel 138 is free to move an additional distance upwardly relative to the intermediate housing for reasons which will be discussed in detail hereinafter. An annular seal 280 is carried on the lower end portion 148 of the upper sampler mandrel 138 and provides a fluid-tight seal between the upper sampler mandrel 138 and the cylindrical inner periphery 274 of the intermediate housing 124 when the upper sampler mandrel is moved downwardly within the intermediate housing as illustrated in FIG. 7B.

The upper sampler mandrel 138 includes an upper annular seal 282 and a lower annular seal 284 carried in the outer periphery thereof. The upper annular seal provides sliding sealing engagement with the cylindrical inner periphery 286 of the top slide valve cylinder 288 of the expandable sampler chamber assembly 38. Valve ports 290 communicate between the passageway 160 and the outer periphery of the upper sampler mandrel 138 above the annular seal 282. Valve ports 292 are formed in the top slide valve cylinder 288 and communicate between the inner periphery 286 and the outer periphery 294 thereof.

Annular seal 284 provides sliding sealing engagement with the cylindrical inner periphery 296 of upper sampler inlet valve cylinder 298 carried by the intermediate housing 124. Inlet valve ports 300 are formed in the valve cylinder 298 and communicate between the inner periphery 296 and the outer periphery 302 of the valve cylinder 298.

The lower sampler mandrel 140 includes an upper annular seal 304 and a lower annular seal 306 carried on the outer periphery thereof. The upper annular seal 304 provides a sliding seal with the cylindrical inner periphery 308 of the lower sampler outlet valve cylinder 310. The cylinder 310 includes outlet valve ports 312 formed therein communicating between the inner periphery 308 and the outer periphery 314 of the cylinder 310.

The lower annular seal 306 provides a sliding seal between the lower sampler mandrel 140 and the cylindrical inner periphery 316 of the lower sampler inlet valve cylinder 318. Inlet valve ports 320 communicate between the inner periphery 316 and the outer periphery 32 of the inlet valve cylinder 318 of the lower housing 126.

The lower housing 126 includes upwardly extending valve mandrel 324 which carries an annular seal 326 which selectively provides sliding sealing engagement with the inner periphery of the passageway 162 at the lower end portion 156 of the lower sampler mandrel 140 as shown in FIG. 7B.

The upper end portion 130 of the intermediate housing 124 includes the radially outwardly extendiing annular flange 328 which is slidably received within a cylindrically shaped chamber 330 formed in the lower end portion 128 of the upper housing 122. An annular seal 332 carried by the flange 328 provides a sliding fluid-tight seal between the flange 328 and the cylindrical inner periphery 334 of the chamber 330. The upper housing 122 and the intermediate housing 124 are retained in sliding telescoping engagement with each other by means of a radially inwardly extending annular flange 336 formed on the lower end portion 128 of the upper housing 122.

The annular chamber defined by the annular space between the upper sampler mandrel 138 and the upper and intermediate housings 122 and 124, and further defined by the annular seals 282, 284 and 332, provides the upper expandable sampler chamber 338 of the flow direction valve and expandable sampler chamber assembly 38.

The upper end portion 134 of the lower housing 126 includes a radially outwardly extending annular flange 340 which is slidably received within a cylindrical chamber 342 formed within the lower end portion 132 of the intermediate housing 124. An annular seal 344 carried by the flange 340 provides a slidiing fluid-tight seal between the flange 340 and the cylindrical inner periphery 346 of the chamber 342. The lower housing 126 is retained in sliding telescoping engagement with the intermediate housing 124 by means of a radially inwardly extending annular flange 348 formed on the lower end portion 132 of the intermediate housing 124 and mutually engageable with the annular flange 340 of the lower housing 126. The annular chamber defined by the space between the outer periphery of the lower sampler mandrel 140 and the intermediate and lower housings 124 and 126, and further defined by the annular seals 304, 306 and 344, provides the lower expandable sampler chamber 350 of the flow direction valve and expandable sampler chamber assembly 38.

An annular chamber 352 is formed in the lower housing 126 and communicates with the inlet valve ports 320 of the lower expandable sampler chamber in the valve cylinder 318 as well as with the lower end portion 156 of the lower sampler mandrel 140 and the flow direction valve mandrel 324. Passageways 354 communicate between the annular chamber 352 and a longitudinal passageway 356 which extends through the lower end portion of the lower housing 126.

Fluid communication between the annular seal 284 and the annular seal 304 carried by the mandrel assembly 120 is provided by an upper annular passageway 360, a lower annular passageway 362 and a plurality of longitudinal ports or passageways 364 interconnecting the passageways 360 and 362, all of which are formed within the intermediate housing 124 surrounding the mandrel assembly 120.

FIGS. 6A and 6C illustrate the relative positions of the various elements of the housiing assembly 118 and the mandrel assembly 120 of the flow direction valve and expandable sampler chamber assembly 38 when the drill test string 10 is introduced into the well bore to be tested. It will be seen that the operating mandrel 136 is in its uppermost position relative to the upper housing 122 with the lugs 166 in position No. 1 in the respective J-slots 168. The upper sampler mandrel 138 is secured in its uppermost position within the upper housing 122 through the engagement of the locking fingers 222 with the upper housing as described above. The upper, intermediate and lower housings 122, 124 and 126 are mutually telescopically extended to the maximum extent. The lower sampler mandrel 140 is locked in its uppermost position within the intermediate housing 124 through the engagement of the intermediate housing by the locking fingers 240 as described above. The upper and lower sampler chambers 338 and 350 are closed by the annular seals 282 and 284 of the upper sampler mandrel and by the annular seals 304 and 306 of the lower sampler mandrel. It will be seen that the flow direction valve and expandable sampler chamber assembly 38 is completely open to fluid passage therethrough via passageways 158, 160, 162, 354 and 356 as well as the annular chambers 352 and 360.

FIGS. 6A and 6B illustrate the relative positions of the elements of the flow direction valve and expandable sampler chamber assembly 38 when the packer assembly 46 is set prior to the taking of samples from the formation or zone under test. It will be seen that the upper and lower expandable sampler chambers 338 and 350 remain closed by the annular seals carried by the upper and lower sampler mandrels 138 and 140 and the assembly 38 is opened to fluid flow therethrough bypassing the sampler chambers 338 and 350.

FIGS. 7A and 7B illustrate the relative positions of the various elements of the expandable sampler chamber assembly 38 at such time as it is desired to take fluid samples from the zone under test. It will be seen that the operating mandrel 136 is in its lowermost position relative to the upper housing 122 at which time the lugs 166 are in either position No. 2 or positions No. 4 in their respective J-slots 168 as shown in FIG. 14. The upper sampler mandrel 138 is released from engagement with the upper housing 122 and is secured to the operating mandrel 136 by means of the spring locking fingers 222 as described above. In a similar manner the lower sampler mandrel 140 is disengaged from the intermediate 124 and is secured to the upper sampler mandrel 138 by means of spring locking fingers 240 as also described above.

The flow direction valve mandrel 324 is received within the lower end portion 156 of the lower sampler mandrel 140 with the annular seal 326 in sealing engagement with the inner periphery of the passageway 162. The sealing engagement between the flow direction valve mandrel and the lower sampler mandrel prevents fluid communication between the annular chamber 352 and the passageway 162. The annular seal 306 is positioned below the inlet valve ports 320 thereby providing fluid communication between the annular chamber 352 and the lower sampler chamber 350. The annular seal 304 is positioned below the outlet valve ports 312 thereby placing the lower sampler chamber 350 in fluid communication with the annular passageways 360 and 362 and longitudinal ports or passageways 364 via the outlet valve ports 312. The annular seal 284 is positioned below the inlet valve ports 300 thereby placing the upper annular passageway 360 in communication with the upper expandable sampler chamber 338 via the inlet valve ports 300. The annular seal 282 is positioned below the valve ports 292 in the top slide valve cylinder 288. The valve ports 290 in the upper sampler mandrel are positioned in registration with the valve ports 292 in the top slide valve cylinder 288 thereby placing the upper sampler chamber in communication with the passageway 160 of the upper sampler mandrel 138 which forms a portion of the tubular passageway 154 of the mandrel assembly 120. The relative position of the elements of the expandable sampler chamber assembly 38 illustrated in FIGS. 7a and 7A is achieved by setting drill string weight on the operating mandrel 136 as described above.

It will be readily apparent that when the elements of the assembly 38 are in the positions illustrated in FIGS. 7A and 7B, fluid samples from the zone under test may flow upwardly through the lower and upper sampler chambers 350 and 338 to the drill string above the assembly 38. When it is desired to trap samples within the upper and lower sampler chambers, weight is removed from the operating mandrel 136 to the extend that the upward bias of the compression spring 170 will move the operating mandrel upwardly until the lugs 166 move into either position No. 3 or position No. 5 in the respective J-slots 168. At this time the sampler 38 again assumes the position illustrated in FIGS. 6A and 6B.

It will be seen in FIG. 6B that the upper and lower sampler chambers 338 and 350 are now closed by the annular seals 282, 284, 304 and 306 thus trapping fluid samples from the zone under test therein.

When the drill test string 10 is retrieved from the well bore after testing, the flow direction valve and expandable sampler chamber assembly 38 again assumes the position illustrated in FIGS. 6A and 6C wherein the housing assembly 118 is fully telescopically extended. When in this position, the assembly 38 provides elongation of the upper and lower expandable sampler chambers 338 and 350 thus providing for a substantial reduction in pressure in the well fluid samples trapped therein. The expansion of the upper and lower sampler chambers greatly facilitates the handling of well fluid samples at the ground surface when the drill test string 10 is removed from the well bore thus providing increased safety of operation when taking well fluid tests in extremely deep wells where the zone under test produces well fluids at extremely high temperatures and pressures.

The lower end portion 358 of the lower housing 126 is threadedly secured to the upper portion of the flow stream recorder assembly 40. The flow stream recorder assembly 40 includes a flow stream recorder 366 carried within a housing 368 and in fluid communication with any fluids passing through the housing 368 via passageway 370 which communicates between the upper and lower ends of the housing 368.

The lower end portion of the housing 368 is threadedly secured to the upper end portion of the hydraulic jar assembly 42 of conventional design. A suitable hydraulic jar assembly for this application is disclosed in U.S. Pat. No. 3,429,389, incorporated by reference herein, and is manufactured and sold by Halliburton Services under the registered trademark BIG JOHN and is further described and illustrated on pages 2556 and 2557 of the Halliburton Services Sales and Service Catalog, Number 37. The hydraulic jar assembly 42 provides means for delivering an impact blow to the drill test string 10 in the event the test string becomes stuck in the well bore.

The lower end portion of the hydraulic jar assembly 42 is threadedly secured to the upper end portion of the upper safety joint assembly 44. The upper safety joint assembly 44 is of conventional construction. A suitable safety joint for this application is disclosed in U.S. Pat. No. 2,877,851, incorporated herein by reference, and known as the VR safety joint manufactured and sold by Halliburton Services and further described and illustrated on page 2557 of the above-identified catalog. The lower end portion of the upper safety joint 44 is threadedly secured to the upper end portion of the packer assembly 46.

Figure 10:
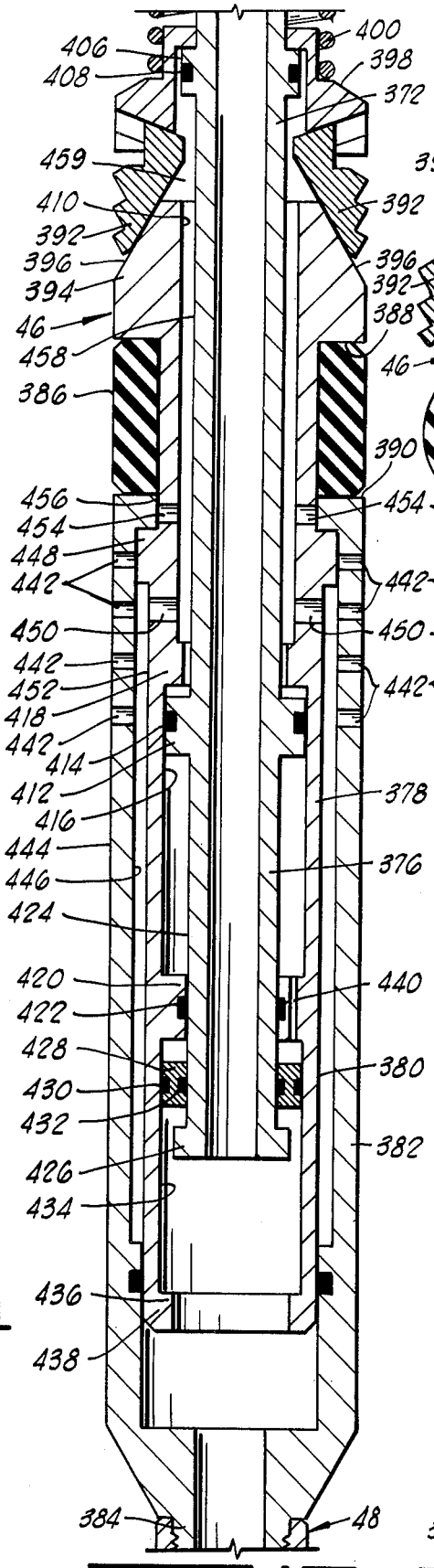
FIG. 10 is an enlarged vertical cross-sectional view of the portion of the drill test string of FIG. 1 illustrating the lower portion of the packer assembly and the upper end portion of the anchor pipe safety joint assembly, with the packer assembly in the unseated position.
Figure 11:
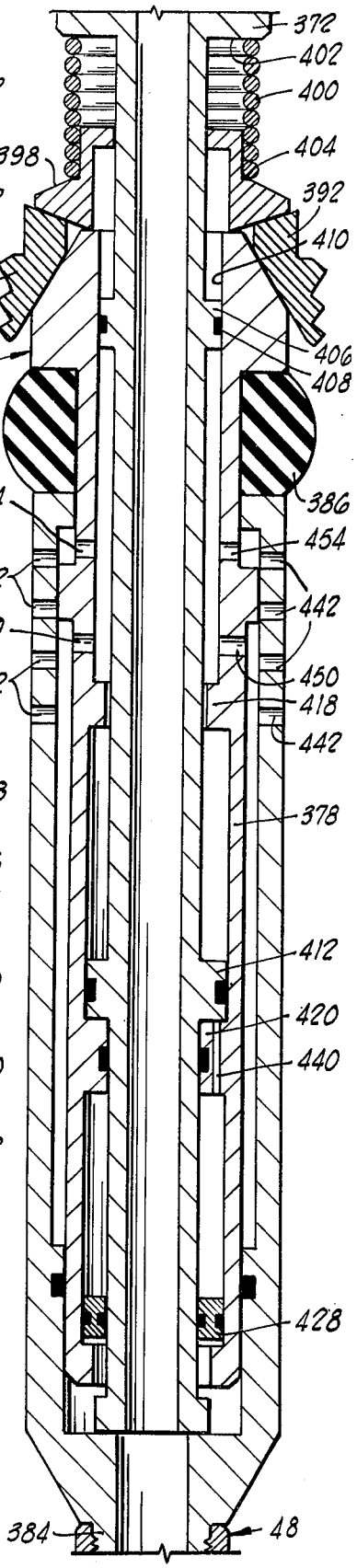
FIG. 11 is an enlarged vertical cross-sectional view of a portion of the drill test string of FIG. 1, similar to FIG. 10 and illustrating the packer assembly in the seated or set position.

Referring now to FIGS. 9, 10 and 11, the packer assembly 46 includes an operating mandrel 372 which is threadedly secured at the upper end 374 thereof to the lower end portion of the upper safety joint 44. The lower portion 376 of the operating mandrel is slidably received within a tubular packer mandrel 378. The lower end portion 380 of the packer mandrel is slidably received within the tubular packer housing 382 the lower end portion 384 of which is threadedly secured to the upper end portion of the lower or anchor pipe safety joint assembly 48. An annular elastomeric or rubber compression packer element 386 is disposed around the packer mandrel 378 and is positioned between a downwardly facing shoulder 388 formed on the packer mandrel and an upwardly facing annular shoulder 390 formed on the packer housing such that as the shoulders 388 and 390 of the packer mandrel and packer housing are moved relatively toward each other, the packer element 386 is compressed and thereby expanded radially outwardly as shown in FIG. 11 to seal against the wall of the well bore as shown in FIG. 1.

A plurality of locking slips 392 are disposed in circumferentially spaced relation about the upper end portion 394 of the packer mandrel 378 each in slidable relation to a respective inclined surface 396 formed on the upper end portion 394 of the packer mandrel. An annular slip mounting member 398 is disposed around the operating mandrel 372 to provide suitable means for securing the slips 392 to the packer assembly 46.

A compression coil spring 400 extends between the downwardly facing annular shoulder 402 formed on the operating mandrel 372 and an upwardly facing annular shoulder 404 formed on the slip mounting member 398.

The operating mandrel 372 includes a radially outwardly extending annular flange 406 having an annular seal 408 mounted thereon. The annular flange 406 and seal 408 are sized to be slidingly sealingly received within the upper cylindrical inner surface 410 formed in the packer mandrel 378 when the packer is set as illustrated in FIG. 11. The annular flange 406 is positioned above the cylindrical inner surface 410 when the packer assembly is unseated as shown in FIG. 10.

A second radially outwardly extending annular flange 412 is formed on the operating mandrel 372 a distance below the flange 406 and includes an annular seal 414 carried therein. The flange 412 and seal 414 provide a sliding fluid-tight seal with an intermediate cylindrical inner surface 416 formed in the packer mandrel 378. The surface 416 extends between a radially inwardly extending upper flange 418 and a radially inwardly extending intermediate flange 420 formed in the packer mandrel 378. The flange 420 carries an annular seal 422 which provides a slidiing fluid-tight seal with the cylindrical outer periphery 424 of the operating mandrel which extends between the intermediate annular flange 412 and a lower radially outwardly extending annular flange 426 formed on the lower end of the operating mandrel.

An annular pressure equalization piston 428 having annular seals 430 and 432 mounted thereon is disposed around the operating mandrel intermediate the lower flange 426 thereof and the flange 420 of the packer mandrel. The piston 428 provides a sliding fluid-tight seal between the cylindrical outer periphery 424 of the operating mandrel and the lower cylindrical inner surface 434 formed in the packer mandrel and extending between the flange 420 and the lower radially extending annular flange 436 formed on the lower end 438 of the packer mandrel. One or more passageways 440 having a predetermined cross-sectional area extend longitudinally through the flange 420.

The annular space between the operating mandrel 372 and the packer mandrel 378 intermediate the annular seals 414, 430 and 432 and interconnected by the passageways 440 defines a conventional hydraulic impedance chamber preferably filled with oil. The hydraulic impedance mechanism retards the relative longitudinal movement between the operating mandrel 372 and the packer mandrel 378.

The packer housing 382 includes a pluality of ports 442 formed therein and extending between the outer periphery 444 and a cylindrical inner surface 446 of the packer housing. A radially outwardly extending annular flange 448 is formed on the outer periphery of the packer mandrel 378. A plurality of ports 450 are formed in the packer mandrel and communicate between the upper cylindrical surface 410 and the cylindrical outer periphery 452 of the packer mandrel. A plurality of ports 454 are formed in the packer mandrel and communicate between the upper cylindrical inner surface 410 and the cylindrical outer periphery 456 of the packer mandrel.

When the packer assembly 46 is in the relaxed or unseated position, as when the drill test string 10 is going into the well bore or at such time as the packer assembly 46 is being unseated by lifting the drill test string 10 and the operating mandrel 372, it will be seen that fluid communcation is provided bypassing the packer element 386 via the ports 442 and 450 and the annular passageway between the cylindrical surface 446 and outer periphery 452, and the annular passageway between the cylindrical surface 410 and the cylindrical outer periphery 458 of the operating mandrel through openings around the locking slips 392 as shown at 459. This bypassing action permits pressure equalization around the packer element 386 if the packer element remains sealingly engaged with the wall of the well bore after an unsuccessful attempt to unseat the packer assembly 46. This bypassing action also permits circulation or reverse circulation through the packer assembly 46 even though the packer element 386 fails to unseat.

It will be seen in FIG. 11 that when the packer assembly 46 is seated and the packer element 386 is expanded to sealingly engage the wall of the well bore, the flange 406 and the annular seal 408 of the operating mandrel seal against the cylindrical inner surface 410 of the packer mandrel thereby preventing fluid bypass around the packer element 386. It will also be seen in FIG. 11 that the operating mandrel 372, after suitable hydraulic delay, forces the packer mandrel 378 downwardly relative to the packer housing 382 through the mutual engagement of the flanges 412 and 420 of the operating mandrel and packer mandrel, respectively.

It will be further seen in FIG. 11 that when the operating mandrel 372 is forced downwardly relative to the packer housing 382 to set the packer, the compression coil spring 400 is compressed thereby forcing the slip mounting member 398 downwardly which, in turn, forces the locking slips 392 radially outwardly into engagement with the wall of the well bore to lock the packer assembly 46 in its seated or set position in the well bore.

The lower or anchor pipe safety joint assembly 48, the upper end of which is threadedly secured to the lower end portion 384 of the packer housing 382, is of conventional design. An anchor pipe safety joint manufactured and sold by Halliburton Services and illustrated at page 2557 in the Halliburton Services Sales and Service Catalog, Number 37 may be suitably employed in this application. The anchor pipe safety joint assembly provides means for releasing the test string in the event the protion below the packer assembly becomes stuck in the well bore.

The lower end of the anchor pipe safety joint assembly 48 is threadedly secured to the upper end of the perforated anchor pipe 50 which is of conventional construction and may be either slotted or perforated. The lower end of the anchor pipe 50 is threadedly secured to the upper end of the check valve assembly 52. The check valve assembly 52 includes a valve body 460 having a longitudinal passageway 462 extending therethrough. The upper end portion 464 of the longitudinal passageway includes a downwardly facing conical valve seat 466 formed therein. The longitudinal passageway 462 is intersected by a plurality of relatively large diameter ports 468 formed in the housing 460 which communicate between the passageway 462 and the exterior of the housing. A longitudinal valve member 470 is longitudinally slidably disposed within the passageway 462 and includes a conically shaped valve head 472 formed thereon which sealingly engages the valve seat 466 through the upward urging of the compression coil spring 474.

The check valve assembly 52 provides means for relieving pressure within the drill test string 10 in the even the perforations in the anchor pipe 50 become plugged during sample testing thereby preventing the pumping of well fluid from the zone under test back into the zone through the anchor pipe. In the event the anchor pipe is so plugged, increased pressure within the drill test string 10 causing a pressure differential across closed valve will force the valve member 470 downwardly within the valve body 460 thereby providing fluid release from the interior of the drill test string through the ports 468 into the zone under test.

The lower end of the check valve assembly 52 is threadedly secured to the upper end of the maximum temperature thermometer assembly 54. The maximum temperature thermometer assembly includes a housing 476 within which a maximum temperature thermometer 478 is disposed. A port 480 provides fluid communication between the exterior of the housing 476 and the thermometer 478.

The lower end of the maximum temperature thermometer assembly 54 is threadedly secured to the upper end of a conventional temperature recorder assembly 56. A suitable temperature recorder for use in this application is available from Halliburton Services and is designated as the HT-500 Temperature Recorder and is illustrated on page 2554 of the Halliburton Services Sales and Service Catalog, Number 37.

The lower end of the temperature recorder assembly 56 is threadedly secured to the upper end of the upper blanked-off pressure recorder assembly 58. The assembly 58 includes a housing 482 within which a Bourdon tube pressure recording device 484 is housed. Fluid communication between the exterior of the housing 482 and the recording device 484 is provided by port 486 formed in the housing 482. A suitable Bourdon tube pressure recording device is available from Halliburton Services and is illustrated in the Halliburton Services Sales and Service Catalog, Number 37 at page 2554.

The lower end of the upper blanked-off pressure recording assembly 58 is threadedly secured to the upper end of the tubular spacer element 60. The tubular spacer element 60 is of a preselected length to provide suitable spacing between the upper blanked-off pressure recording assembly 58 and the lower blanked-off pressure recording assembly 62, the upper end of which is threadedly secured to the lower end of the tubular spacer element 60. The lower blanked-off pressure recorder assembly 62 is substantially identical to the upper blanked-off pressure recorder assembly 58. The lower end of the lower blanked-off pressure recorder assembly 62 is secured to the anchor shoe 64 which provides suitable means for engaging the bottom of the well bore with the drill test string 10.

OPERATION

In operation the drill test string 10 is lowered into a well bore which intercepts a zone in a formation which zone contains well fluids which require testing and of which it is desired to obtain samples. The drill test string 10 is lowered into the well bore with the flow direction valve and expandable sampler chamber assembly 38 in the open position as illustrated in FIGS. 6A and 6C. It will be understood that the well bore at the time of introduction of the drill test string 10 contains a column of mud which exerts sufficient hydrostatic pressure on the zone under test to exceed the formation pressure and to retain the formation fluids in the formation to thereby prevent their entry into the well bore. It will be understood, further, that the drill test string is completely open from bottom to top so that it will fill with mud as the drill test string is lowered into the well bore.

When the drill test string 10 is completely lowered into the well bore, with the anchor shoe 64 engaging the bottom of the well bore the transverse passage 70 of the sleeve type safety valve assembly 18 is connected by means of conduit 486 and a valve 488 to a suitable pump 490 connected to a displacement fluid reservoir 492. The transverse passageway 86 of the flow cross kill line connection assembly 22 is connected by means of a suitable conduit 494 and valve 496 to a suitable pump 498 which is in turn connected to a suitable reservoir 500 for mud or the like.

With packer assembly 46 in its unseated position, as illustrated in FIG. 10, and with the sampler chamber assembly 38 in its open or flowing position as illustrated in FIGS. 6A and 6B, valve 488 is opened and valve 496 is closed and cylindrical valve member 72 of the sleeve type safety valve assembly 18 is maintained in its uppermost open position. The pump 490 is then started and forces a predetermined quantity of displacement fluid, preferably diesel oil, through the conduit 486 and open valve 488 downwardly through the drill test string 10 to displace the heavier mud downwardly through the drill test string and out through the perforations in the perforated anchor pipe 50 and upwardly through the annulus between the drill test string 10 and the well bore with excess mud flowing to the mud reservoir 500 through conduit 502 and open valve 504. The volume of displacement fluid pumped downwardly through the drill test string 10 is predetermined such that the hydrostatic head within the drill test string acting on the zone under test after the introduction of the predetermined volume of displacement fluid is less than the formation pressure in the zone under test.

At this point, while holding pressure on the column of fluid in the drill test string or conduit means, the packer assembly 46 is set by setting drill test string weight on the packer assembly thereby isolating the annulus above the packer assembly 46 from the zone under test. It will be understood that during the setting of the packer assembly 46 pressure is retained on the liquid column within the drill test string 10 by closing the valve 488.

When the packer assembly 46 is set, the upper and lower expandable sampler chambers 338 and 350 are opened by setting drill test string weight on the sampler chamber assembly 38 thus placing the elements thereof in the positions illustrated in FIGS. 7A and 7B. It will be understood that this opening of the expandable sampler chambers 338 and 350 is accompanied by movement of the lugs 166 from position No. 1 to position No. 2 in the respective J-slots 168 as illustrated in FIG. 14.

The hydraulic pressure acting on the zone under test is then reduced by opening the valve 488 a predetermined amount to allow the formation pressure in the zone under test, which, as noted above, is greater than the hydrostatic pressure of the fluid column within the drill test string 10, to displace the fluid column within the drill test string 10 upwardly allowing a portion of the displacement fluid to flow through the conduit 486 and the open valve 488 back to the reservoir 492. When a sufficient volume of displacement fluid has been forced through the conduit 486 and valve 488 back to the reservoir 492 to assure that well fluids from the zone under test have passed upwardly through the drill test string 10, including the open expandable sampler chambers 350 and 338, to a position above the expandable sampler chamber assembly 38, the valve 488 is closed. During the period of time when well fluids are flowing from the formation in the zone under test into the perforated anchor pipe 50 and upwardly through the lower portion of the drill test string 10, temperature and pressure readings are taken and recorded by the maximum temperature thermometer assembly 54, the temperature recorder assembly 56, the upper blanked-off pressure recorder assembly 58 and the lower blanked-off pressure recorder assembly 62.

To secure samples of the well fluid from the formation in the zone under test, the expandable sampler chambers 438 and 450 are closed trapping samples therein by lifting drill test string weight from the expandable sampler chamber assembly 38 and placing the various elements thereof in the positions illustrated in FIGS. 6A and 6B. It will be understood that during the closure of the sampler chambers thus described, the lugs 166 move from position No. 2 to position No. 3 in the respective J-slots 168 as illustrated in FIG. 14.

In the event of some unforeseen malfunction in the above-described sampling procedure, the expandable sampler chambers 338 and 350 may be opened one more time in a manner as described above which will occasion the movement of the lugs 166, from a position No. 3 to position No. 4 within the respective J-slots as illustrated in FIG. 14. Similarly, samples may be trapped in the expandable sampler chambers 338 and 350 by reducing the drill test string weight on the expandable sampler chamber assembly 38 a second time thereby again placing the elements thereof in the position illustrated in FIGS. 6A and 6B causing the movement of the lugs 166 from position No. 4 to position No. 5 in the respective J-slots 168 as again illustrated in FIG. 14. Any additional vertical manipulation of the drill test string 10 relative to the expandable sampler chamber assembly 38 will not again open the expandable sampler chambers 438 and 450, and the lugs 166 will move vertically only between position No. 5 and position No. 6 in the J-slots 168 and as illustrated in FIG. 14.

After the well fluid samples have been trapped in the expandable sampler chambers 338 and 350, it is deemed preferable to open the valve 488 and actuate the pump 490 to increase the hydraulic pressure within the drill test string 10 to force the remaining formation fluid in the drill test string from the lower end thereof back into the formation in the zone under test. When the hydraulic pressure above and below the set packer has become equalized, the packer assembly 46 may be unseated and mud may be pumped into the annulus between the drill test string 10 and the well bore from the mud reservoir 500 by the pump 498 through conduit 502 and open valve 504 to reverse circulate mud through the perforated anchor pipe 50 and displace the displacement fluid from the drill test string through conduit 486 and valve 488 into the displacement fluid reservoir 492. The valve 488 will be suitably manipulated at the ground surface to maintain pressure in the drill test string at a level greater than the formation pressure of the zone under test during this reverse circulation. When the predetermined known volume of displacement fluid has been returned to the displacement fluid reservoir 492, and when any residual formation fluid from the zone under test has been removed from the drill test string through conduit 506 and valve 508 to a suitable reservoir 510, sufficient mud will be disposed within the well bore to exceed the formation pressure thus allowing the drill test string 10 to be removed from the well bore with the well fluid samples secure in the sampler chamber 338 and 350. It will be understood that upon withdrawal of the drill test string 10 from the well bore, the expandable sampler chambers 338 and 350 will be expanded to substantially increase the volumes thereof and thereby reduce the pressure of the well fluid samples trapped therein as illustrated in FIG. 6C.

In the event it is found to be impossible or undesirable to pump the well fluids from the zone under test back into the formation from which they came, the same process as described above may still be employed although a greater volume of well fluids will have to be controlled at the ground surface through conduit 506 and valve 508 to the reservoir 510. It will also be understood that, if desired, the well fluids may be removed by circulating mud down the drill test string 10 through the anchor pipe 50 and up through the annulus with pump 498.

In the event the packer assembly 46 becomes stuck and cannot be unseated in the well bore, it will be noted that normal circulation or reverse circulation of the mud may still be maintained around the packer assembly 46 through the opening 459, annular space between the upper cylindrical inner surface 410 and the cylindrical outer periphery 458, and ports 454, 450 and 442 of the packer assembly 46. The drill test string may then be released from the packer assembly through the actuation of the upper safety joint 44 in the usual conventional manner.

It should also be noted that, in the event the well fluids cannot be pumped back into the formation in the zone under test, the displacement fluid in the drill test string 10 may be removed therefrom by reverse circulating the mud from the pump 498 down the annulus and through the anchor pipe 50 or through the previously actuated sleeve impact reversing sub 30. When the drill test string 10 is removed from the well bore the flow direction valve and expandable sampler chamber assembly 38 may be disassembled therefrom and removed from the well site to a suitable controlled environment where the well fluid samples trapped in the upper and lower expandable sampler chambers 338 and 350 may be removed by suitable means (not shown) for further testing and evaluation.

It should be understood that the method and apparatus of the invention may be altered, if desired to utilize only one sampler chamber or to utilize a non-expandable sampler chamber in substitution for one or both of the expandable sampler chambers 338 and 350.

It will be seen that the foregoing detailed description of the present invention that the drill test string employing the flow direction and expandable sampler chamber assembly and its novel method of employment provide convenient and safe means for testing a formation in a zone wherein the formation pressure is approximately 20,000 p.s.i. and the temperatures encountered are approximately 450° F., and where the well fluids are anticipated to contain quantities of $H_2S$ and/or $CO_2$.

Changes may be made in the combination and arrangement of the parts or elements as heretofore set forth in the specification and shown in the drawings without departing from the spirit and scope of the invention as defined by the following claims.

What is claimed is:

1. A method of testing a formation in a zone intersected by a well bore, comprising the steps of:

a. maintaining hydrostatic pressure on the formation with a column of a first liquid in the well bore, said hydrostatic pressure exceeding the formation pressure at the zone;

b. positioning an open conduit in the well bore with the lower end thereof opening proximate to the zone under test;

c. displacing a quantity of the first liquid from the lower end of the conduit into the annulus between the conduit and the well bore with a second liquid of a density less than the density of the first liquid;

d. isolating the annulus above the zone under test from said zone;

e. reducing the hydraulic pressure acting on the zone under test below the formation pressure of the zone under test;

f. allowing fluid from the formation in the zone under test to enter the lower end of the conduit and flow therethrough; and g. trapping a sample of formation fluid in the conduit.

2. The method as defined in claim 1 characterized further to include the additional steps of:

providing fluid communication between the annulus and the zone under test; and pumping a quantity of the first liquid from the annulus into the zone under test and into the lower end of the conduit, while maintaining hydraulic pressure in the zone under test greater than the formation pressure, to displace the quantity of second liquid from the conduit.

3. The method as defined in claim 1 characterized further to include the additional steps of:

increasing the hydraulic pressure in the conduit to force the remaining formation fluid from the lower end of the conduit back into the formation in the zone under test;

providing fluid communication between the annulus and the zone under test; and pumping a quantity of the first liquid from the annulus into the zone under test and into the lower end of the conduit, while maintaining hydraulic pressure in the zone under test greater than the formation pressure, to displace the quantity of second liquid from the conduit.

4. A method of testing a formation in a zone intersected by a well bore, comprising the steps of:

a. maintaining hydraulic pressure on the formation with a column of a first liquid in the well bore, said hydraulic pressure exceeding the formation pressure at the zone;

b. positioning an open conduit in the well bore with the lower end portion thereof opening proximate to the formation in the zone under test;

c. displacing a quantity of the first liquid from the lower end portion of the conduit into the annulus between the exterior of the conduit and the well bore with a second liquid having a density less than the first liquid;

d. isolating the annulus above the zone under test from said zone;

e. reducing the hydraulic pressure acting on the zone under test to a value below the formation pressure of the zone under test;

f. allowing fluid from the formation in the zone under test to enter the lower end portion of the conduit and flow upwardly therethrough;

g. trapping a sample of the formation fluid in the conduit;

h. increasing the pressure in the conduit to a value greater than the formation pressure of the zone under test to force the remaining formation fluid from the lower end portion of the conduit back into the formation in the zone under test;

i. placing the annulus and the zone under test in fluid communication;

j. increasing the pressure in the annulus to displace the second liquid from the conduit, while maintaining hydraulic pressure in the zone under test at a value greater than the formation pressure;

k. increasing the volume of the trapped sample to lower the pressure thereof; and l. removing the conduit and trapped sample of formation fluid from the well bore.

5. A method of testing a formation in a zone intersected by a well bore, said formation containing a formation fluid at a formation pressure, and said well bore containing a column of first liquid exerting a hydrostatic pressure on said formation in excess of the formation pressure, comprising the steps of:

a. disposing a well test string comprising a conduit and formation testing apparatus communicating with the lower end of the conduit in the well bore, said apparatus including a formation fluid flow direction valve assembly, an expandable formation fluid sampler chamber assembly, and a packer assembly, said sampler chamber assembly being in a closed position and said conduit and formation testing apparatus being open to allow fluid passage therethrough around said closed sampler chamber assembly;

b. introducing a second liquid into the conduit having a density less than the density of the first liquid to displace at least a portion of the first liquid from the well testing string;

c. manipulating the well test string to set the packer assembly and isolate the zone in communication with the formation testing apparatus;

d. manipulating the well test string to actuate the flow direction valve assembly and open the sampler chamber assembly to direct fluid passing through the formation testing apparatus through the sampler chamber asembly;

e. reducing the pressure acting on the zone to a value less than the formation pressure;

f. allowing formation fluid to enter the formation testing apparatus from the zone and pass through the sampler chamber assembly;

g. manipulating the well test string to actuate the flow direction valve assembly and close the sampler chamber assembly to trap a sample of formation fluid therein and to direct fluid passing through the formation testing apparatus around the closed sampler chamber assembly;

h. increasing the pressure acting on the zone to a value greater than the formation pressure;

i. manipulating the well test string to release the packer assembly;

j. introducing first liquid in the annulus and displacing the second liquid and any residual formation fluid from the well test string; and k. withdrawing the trapped sample of formation fluid from the well bore.

6. A method of testing a formation in a zone intersected by a well bore, said formation containing a formation fluid at a formation pressure, and said well bore containing a column of first liquid exerting a hydrostatic pressure on said formation in excess of the formation pressure, comprising the steps of:

a. disposing a well test string comprising a conduit and formation testing apparatus communicating with the lower end of the conduit in the well bore, said apparatus including a formation fluid flow direction valve assembly, an expandable formation fluid sampler chamber assembly, and a packer assembly, said sampler chamber assembly being in a closed position and said conduit and formation testing apparatus being open to allow fluid passage therethrough around said closed sampler chamber assembly;

b. introducing a second liquid into the conduit having a density less than the density of the first liquid to displace at least a portion of the first liquid from the well testing string;

c. manipulating the well test string to set the packer assembly and isolate the zone in communication with the formation testing apparatus;

d. manipulating the well test string to actuate the flow direction valve assembly and open the sampler chamber assembly to direct fluid passing through the formation testing apparatus through the sampler chamber assembly;

e. reducing the pressure acting on the zone to a value less than the formation pressure;

f. allowing formation fluid to enter the formation testing apparatus from the zone and pass through the sampler chamber assembly;

g. manipulating the well test string to actuate the flow direction valve assembly and close the sampler chamber assembly to a trap a sample of formation fluid therein and to direct fluid passing through the formation testing apparatus around the closed sampler chamber assembly;

h. increasing the pressure acting on the zone to a value greater than the formation pressure;

i. manipulating the well test string to release the packer assembly;

j. introducing first liquid in the annulus and displacing the second liquid and any residual formation fluid from the well test string;

k. increasing the volume of the expandable formation fluid sampler chamber assembly to lower the pressure of the formation fluid trapped therein; and l. withdrawing the trapped sample of formation fluid from the well bore.

7. An apparatus for testing an underground formation in a zone penetrated by a well bore, comprising:

a. conduit means positionable in the well bore for conveying fluids therethrough within the well bore; said conduit having at least one port means positionable adjacent said underground formation for providing fluid communication between the formation and the interior of said conduit means;

b. wellbore isolation means, supported by said conduit means, for isolating said underground formation from the annulus between said conduit means and said wellbore above said isolation means;

c. primary passageway means, longitudinally disposed within said conduit means, for allowing fluid communication between said port means and an upper end of said conduit means;

d. sampler chamber means, longitudinally disposed within said conduit means and communicating at two separate locations with said primary passageway, for providing an alternate flow path between said two separate locations;

e. sampler valve means, disposed within said conduit means at said two separate locations, for opening said primary passageway means at said two separate locations and simultaneously closing said sampler chamber means at said two separate locations in response to the absence of a predetermined compressive force on an actuating portion of said conduit means, for opening said sampler chamber means at said two separate locations and closing said primary passageway at said two separate locations in response to the presence of said predetermined force on said portion of said conduit means and for reclosing said sampler chamber means and reopening said primary passageway in response to removal of said predetermined force from said actuating portion; and f. tester valve means, in said conduit means, for selectively opening and closing said conduit means to fluid flow therethrough.

8. The apparatus as defined in claim 7 wherein said sampler chamber means is characterized further to include:

sampler chamber extension means for extending and increasing the volume of said sampler chamber means after trapping a fluid sample therein in response to upward movement of said conduit means relative to said sampler chamber means.

9. The apparatus as defined in claim 7 wherein said well bore isolation means is characterized further to include:

bypass valve means carried by said well bore isolation means for selectively providing fluid communication between the zone under test and the annulus above said well bore isolation means in response to upward movement of said conduit means relative to said well bore isolation means.

10. The apparatus as defined in claim 7 characterized further to include:

gravity responsive safety valve means carried by said conduit means above said sample chamber means for closing said conduit means to fluid flow therethrough in response to conduit weight applied thereto.

11. The apparatus as defined in claim 7 characterized further to include:

sleeve valve means carried by said conduit means above said sampler chamber means for selectively providing fluid communication between the interior and exterior of said conduit means in response to downward impact force applied thereto.

12. The apparatus as defined in claim 7 characterized further to include:

hydraulic pressure responsive check valve means carried by said conduit means below said port means for providing fluid communication between the interior of said conduit means and the zone under test when the pressure within said conduit means exceeds the pressure in the zone under test by a predetermined amount.

13. In a well test string of the type which includes a length of conduit and a packer assembly, the improvement comprising:

a sampler chamber assembly, including:

upper tubular mandrel means for connecting said assembly to the conduit;

a sampler chamber assembly having an upper sampler chamber member slidably receiving and retaining said upper tubular mandrel upper end, a lower sampler chamber member, means for slidably securing the lower sampler chamber member to the upper sampler chamber member to expand and contract a sampler chamber cavity partially formed by portions of the inner peripheries of the upper and lower sampler chamber members, and means for connecting the lower sampler chamber member to the packer assembly;

lower tubular mandrel means slidably disposed within the sampler chamber assembly for longitudinal movement therein, a portion of the outer periphery of said lower tubular mandrel means, in combination with the portions of the inner peripheries of said upper and lower sampler chamber members defining the sampler chamber cavity;

valve means carried by said sampler chamber assembly and said lower tubular mandrel means and responsive to longitudinal movement of said lower tubular mandrel means relative to said sampler chamber assembly for closing the sampler chamber cavity and simultaneously directing fluid flow through said sampler chamber assembly around the closed sampler chamber cavity and, alternately, opening the sampler chamber cavity and simultaneously directing fluid flow through said sampler chamber assembly and through the open sampler chamber cavity; and means for engaging said upper tubular mandrel means and said lower tubular mandrel means to impart longitudinal movement of the conduit to said lower tubular mandrel means.

14. In a well test string of the type which includes a length of conduit and a packer assembly, the improvement comprising:

a sampler chamber assembly, including:

upper tubular mandrel means for connecting said assembly to said conduit;

an upper sampler chamber assembly having an upper sampler chamber member slidably receiving said upper tubular mandrel means therein, means for retaining said tubular mandrel means in engagement with said upper sampler chamber member, a lower sampler chamber member, and means for slidably securing the lower sampler chamber member to the upper sampler chamber member to expand and contract an upper sampler chamber cavity partially defined by portions of the inner peripheries of the upper and lower sampler chamber members;

a lower sampler chamber assembly having an upper sampler chamber member, means for connecting the upper sampler chamber member to the lower sampler chamber member of said upper sampler assembly, a lower sampler chamber member, means for slidably securing the lower sampler chamber member to the upper sampler chamber member to expand and contract a lower sampler chamber cavity partially defined by portions of the inner peripheries of the upper and lower sampler chamber members, and means for connecting the lower sampler chamber member to said packer assembly;

a lower tubular mandrel assembly comprising an upper sampler mandrel slidably disposed within said upper sampler chamber assembly for longitudinal movement therein, a portion of the outer periphery of the upper sampler mandrel in combination with portions of the inner peripheries of the upper and lower sampler chamber members of the upper sampler chamber assembly defining the upper sampler chamber cavity, a lower sampler mandrel slidably disposed within said lower sampler chamber assembly for longitudinal movement therein, a portion of the outer periphery of the lower sampler mandrel in combination with portions of the inner peripheries of the upper and lower sampler chamber members of the lower sampler chamber assembly defining the lower sampler chamber cavity, means for releasably engaging said upper tubular mandrel means and the upper sampler mandrel for selectively imparting longitudinal movement of said conduit to said lower tubular mandrel assembly, and means for interconnecting the upper and lower sampler mandrels and selectively disconnecting the upper and lower sampler mandrels in response to longitudinal upward movement of said conduit relative to said sampler chamber assembly when the upper and lower sampler cavities are expanded; and valve means carried by said upper sampler chamber assembly, said lower sampler chamber assembly and said lower tubular mandrel assembly, responsive to longitudinal movement of said lower tubular mandrel assembly relative to said upper and lower sampler chamber assemblies, for closing the upper and lower sampler chamber cavities and simultaneously directing fluid flow through said upper and lower sampler chamber assemblies around the closed upper and lower sampler chamber cavities, and, alternately, opening the upper and lower sampler chamber cavities and simultaneously directing fluid flow through said upper and lower sampler chamber assemblies and through the open upper and lower sampler chamber cavities.

15. A method of testing a formation in a zone intersected by a well bore, comprising the steps of:

a. maintaining hydrostatic pressure on the formation with a column of a first liquid in the well bore, said hydrostatic pressure exceeding the formation pressure at the zone;

b. positioning an open conduit in the well bore with the lower end thereof opening proximate to the zone under test;

c. displacing a quantity of the first liquid from the lower end of the conduit into the annulus between the conduit and the well bore with a second liquid of a density less than the density of the first liquid;

d. isolating the annulus above the zone under test from said zone;

e. reducing the hydraulic pressure acting on the zone under test below the formation pressure of the zone under test;

f. allowing fluid from the formation in the zone under test to enter the lower end of the conduit and flow therethrough;

g. trapping a sample of formation fluid in the conduit;

h. increasing the hydraulic pressure in the conduit to force the remaining formation fluid from the lower end of the conduit back into the formation in the zone under test;

i. providing fluid communication between the annulus and the zone under test; and j. pumping a quantity of the first liquid from the annulus into the zone under test and into the lower end of the conduit, while maintaining hydraulic pressure in the zone under test greater than the formation pressure, to displace the quantity of second liquid from the conduit.

16. The method as defined in claim 15 characterized further to include the additional step of:

increasing the volume of the trapped sample to lower the pressure thereof.

17. The method as defined in claim 15 characterized further to include the additional step of:

removing the conduit and trapped sample of formation fluid from the well bore.

18. A method of testing a formation in a zone intersected by a well bore, said formation containing a formation fluid at a formation pressure, and said well bore containing a column of liquid exerting a hydrostatic pressure on said formation in excess of the formation pressure, comprising the steps of:

a. disposing a well test string comprising a conduit and formation testing apparatus communicating with the lower end of the conduit in the well bore, an expandable formation fluid sampler chamber assembly, and a packer assembly, said sampler chamber assembly being in a closed position;

b. manipulating the well test string to set the packer assembly and isolate the zone in communication with the formation testing apparatus;

c. reducing the pressure acting on the zone to a value less than the formation pressure;

d. allowing formation fluid to enter the formation testing apparatus from the zone and pass through the sampler chamber assembly;

e. manipulating the well test string to close the sampler chamber assembly to trap a sample of formation fluid therein;

f. manipulating the well test string to release the packer assembly;

g. increasing the volume of the expandable formation fluid sampler chamber assembly to lower the pressure of the formation fluid trapped therein; and h. withdrawing the trapped sample of formation fluid from the well bore.

19. The method of claim 18, further comprising the additional step, simultaneous with said step (e), of:

manipulating the well test string to direct fluid through the formation testing apparatus around the closed sampler chamber assembly.

20. A method of testing a formation in a zone intersected by a well bore, said formation containing a formation fluid at a formation pressure, and said well bore containing a column of first liquid exerting a hydrostatic pressure on said formation in excess of the formation pressure, comprising the steps of:

a. disposing a well test string comprising a conduit and formation testing apparatus communicating with the lower end of the conduit in the well bore, said apparatus including a formation fluid flow direction valve assembly, said sampler chamber assembly being in a closed position and said conduit and formation testing apparatus being open to allow fluid passage therethrough around said closed sampler chamber assembly;

b. manipulating the well test string to set the packer assembly and isolate the zone in communication with the formation testing apparatus;

c. manipulating the well test string to actuate the flow direction of valve assembly and open the sampler chamber assembly to direct fluid passing through the formation testing appparatus through the sampler chamber assembly;

d. reducing the pressure acting on the zone to a value less than the formation pressure;

e. allowing formation fluid to enter the formation testing apparatus from the zone and pass through the sampler chamber assembly;

f. manipulating the well test string to actuate the flow direction valve assembly and close the sampler chamber assembly to trap a sample of formation fluid therein and to direct fluid passing through the formation testing apparatus around the closed sampler chamber assembly;

g. increasing the pressure acting on the zone to a value greater than the formation pressure;

h. manipulating the well test string to release the packer assembly; and i. withdrawing the trapped sample of formation fluid from the well bore.

21. An apparatus, for sampling high pressure fluid containing underground formations penetrated by a well bore, comprising:

a. conduit means positionable in the well bore for conveying fluids therethrough within the well bore;

b. sampler chamber means, carried by said conduit means, for isolating a sample of the fluids conveyed through said conduit means, and for continuously maintaining said sample in isolation during removal of said extended sample chamber from said well bore;

c. sampler chamber extension means, operably associated with said sampler chamber means, for extending and increasing the volume of said sampler chamber means after the fluid sample is isolated and contained therein in response to upward movement of said conduit means; and d. motivator means, associated with said conduit means, for causing the fluids from the underground formation to flow into said sampler chamber means.

* * * * *